United States Patent [19]

Dunn

[11] Patent Number: 4,700,663

[45] Date of Patent: Oct. 20, 1987

[54] AIR COMPRESSOR

[76] Inventor: Larry W. Dunn, Rt. 6, Sanders Dr., Anderson, S.C. 29624

[21] Appl. No.: 839,694

[22] Filed: Apr. 21, 1986

[51] Int. Cl.[4] ..... F04B 41/04

[52] U.S. Cl. ..... 123/1 R; 123/DIG. 6; 123/DIG. 7; 417/237; 417/238; 417/364

[58] Field of Search ..... 123/DIG. 6, DIG. 7, 123/1 R; 60/625, 626, 627, 628, 629, 630, 631; 417/364, 237, 238

[56] References Cited

U.S. PATENT DOCUMENTS

| | | | |
|---|---|---|---|
| 1,502,264 | 7/1924 | Moore | 123/DIG. 6 |
| 1,804,873 | 5/1931 | Hoffman | 123/DIG. 7 |
| 1,992,400 | 2/1935 | Smith | 123/DIG. 7 |
| 3,561,416 | 2/1971 | Kiekhaefer | 123/DIG. 7 |
| 3,945,367 | 3/1976 | Turner | 123/DIG. 7 |
| 3,958,900 | 5/1976 | Veno | 123/DIG. 7 |
| 3,963,379 | 6/1976 | Veno | 123/DIG. 7 |
| 4,255,090 | 3/1981 | Pratt | 417/238 |
| 4,350,475 | 9/1982 | Meece et al. | 417/238 |
| 4,372,257 | 2/1983 | Hofbauer et al. | 417/364 |
| 4,391,568 | 7/1983 | Tenney | 123/DIG. 7 |
| 4,414,936 | 11/1983 | Huff | 123/DIG. 7 |
| 4,473,044 | 9/1984 | Hudson | 123/DIG. 7 |

*Primary Examiner*—Ira S. Lazarus
*Attorney, Agent, or Firm*—Bailey & Hardaway

[57] ABSTRACT

A novel air compressor utilizing a simple modification of an opposing 4 cylinder air cooled Volkswagen internal combustion engine.

4 Claims, 7 Drawing Figures

AIR COMPRESSOR

BACKGROUND OF THE INVENTION

This invention relates generally to the art of air compression and more particularly to an apparatus for modifying a conventional Volkswagen engine for the compression of air.

Various prior art devices have been utilized for the compression of air. Large industrial devices have utilized powerful diesel engines to operate compressor which must be moved about in individual trailers. Various attempts to convert internal combustion engines have also been utilized. One such attempt is described in U.S. Pat. No. 1,804,873 to Hoffman wherein a water cooled Ford engine is modified to provide for air compression in certain cylinders. Other such devices are described in U.S. Pat. Nos. 1,992,400 and 1,485,803. These devices while compressing air are bulky and require significant modification in order to become air compressors.

SUMMARY OF THE INVENTION

It is thus an object of this invention to provide a novel air compressor. It is a further object of this invention to provide such an air compressor which is simple in design.

It is a further object of this invention to provide such an apparatus which is a simple modification of an existing internal combustion engine.

These as well as other objects are accomplished by an apparatus for converting an air cooled internal combustion engine into an air compressor which comprises a cylinder head adapted to mate with the piston housing of an air cooled internal combustion engine. The cylinder head houses spring actuated outlet and inlet valves so as to permit piston movement to compress air without the need for other positively driven moving parts. The cylinder head also includes air cooling fins to assist in cooling the piston housing.

DETAILED DESCRIPTION

In accordance with this invention it has been found that a conventional Volkswagen engine may be adapted to provide for air compression in a simple and economical manner. The air compression apparatus of this invention possesses the advantage of being small, compact and air cooled with a large availability of replacement parts due to the popularity and use of the Volkswagen opposing 4 cylinder engine throughout the world. Various other advantages and features will be come apparent from a reading of the following description given with reference to the various figures of drawing. The essence of this invention is the use of a cylinder head which mates with the cylinder housing of a conventional Volkswagen engine. The cylinder head may be used on virtually any of the four cylinders in the opposing 4 cylinder engine as will be described in more detail below.

Figure 1:
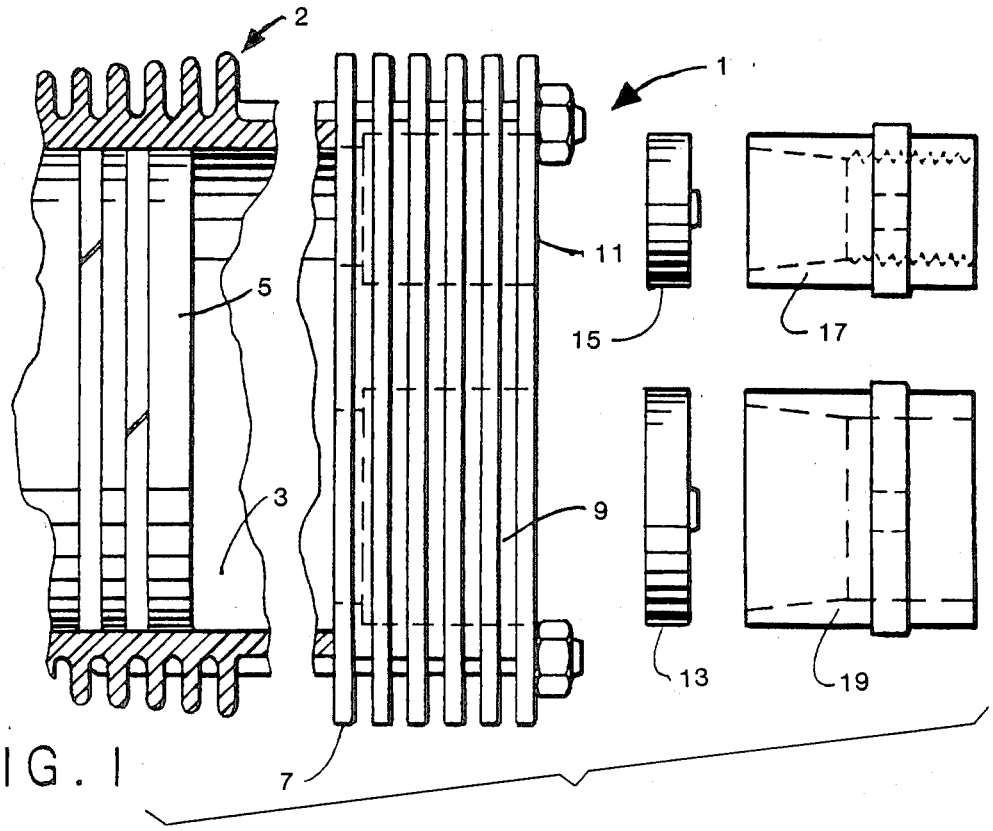
FIG. 1 of the drawings illustrates a cylinder head in accordance with this invention in a sectional assembly view.

FIG. 1 of the drawings illustrates a cross section in assembly view of the cylinder head 1 of this invention in association with the piston housing 2 of a conventional Volkswagen opposing 4 cylinder engine. It should be noted that the cylinder head 1 mates with the cylinder housing 2 in the same way that the operational cylinder head of a Volkswagen mates with such piston housing. For purposes of reference, the piston housing 2 defines a cylinder 3 in which piston 5 reciprocates.

The cylinder head 1 defines cooling fins 7 on the exterior thereof to provide for cooling of the overall device in actual operations. The cylinder head 1 is cast or machined from a block of metal, preferably aluminum, to provide for cooling fins 7 and to provide for an inlet port 9 and an outlet port 11.

Associated with inlet port 9 is an inlet valve 13 and an outlet valve 15 in association with outlet port 15.

Both inlet valve 13 and outlet valve 15 are of spring actuated construction such that upon achieving a certain pressure differential across the valve the valve opens. Of course, the pressure differentials are in opposite directions to achieve opening for valves 13 and 15. Preferably both valves are Champion valves which are commercially available.

Each valve is retained within its port by retention means illustrated here as an outlet valve retaining flange 17 and an inlet valve retaining flange 19.

Due to the compression which occurs during operation of the engine, it has been found desirable, if not critical, to have the inlet port substantially of twice the radius of the outlet port due to the differing volumes of air passing through each port.

Figure 2:
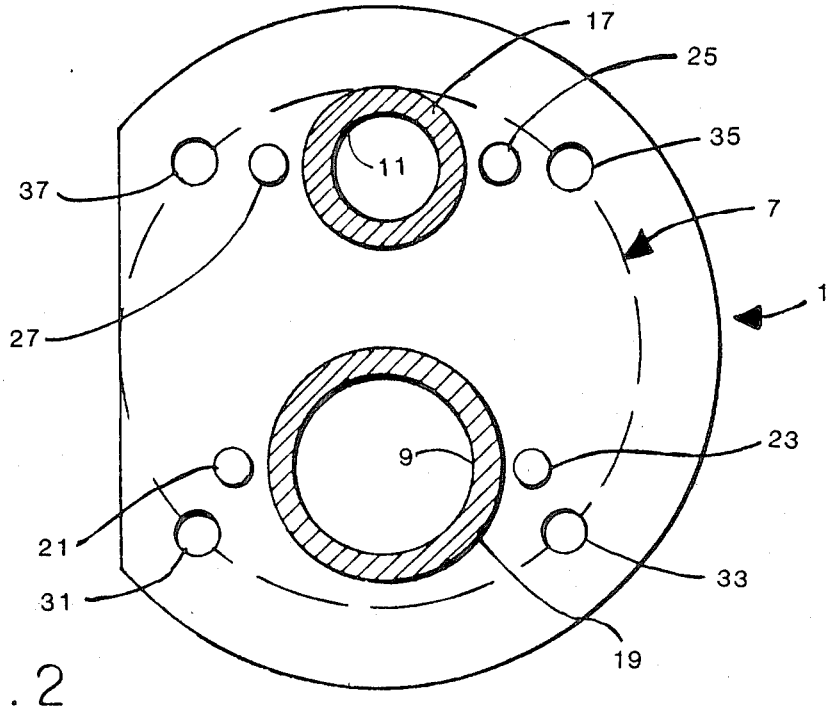
FIG. 2 of the drawings is a top view of a cylinder head in accordance with this invention.

FIG. 2 of the drawings is a top view of the cylinder head in accordance with this invention. As viewed in FIG. 2 the cylinder head 1 illustrates cooling fins 7, inlet port 9, outlet port 11, and retaining flanges 19 and 17 within such ports. The valves are secured in place by studs 21, 23, 25 and 27. The cylinder head 1 of this invention is secured to the cylinder housing 2 by head studs 31, 33, 35 and 37.

The cylinder head of this invention may be utilized on the conventional Volkswagen engine in a number of differing formats. The most practical format is to utilize two cylinder heads on one side of the engine. However, before attempting such a configuration it was felt that the engine would likely not run due to the firing sequence. However, it was surprisingly found that not only did the engine run, but it ran relatively smoothly producing compressed air in a very efficient manner with very little modification of the engine being required. Such a configuration is illustrated in FIGS. 3 and 4 of the drawings.

Figure 3:
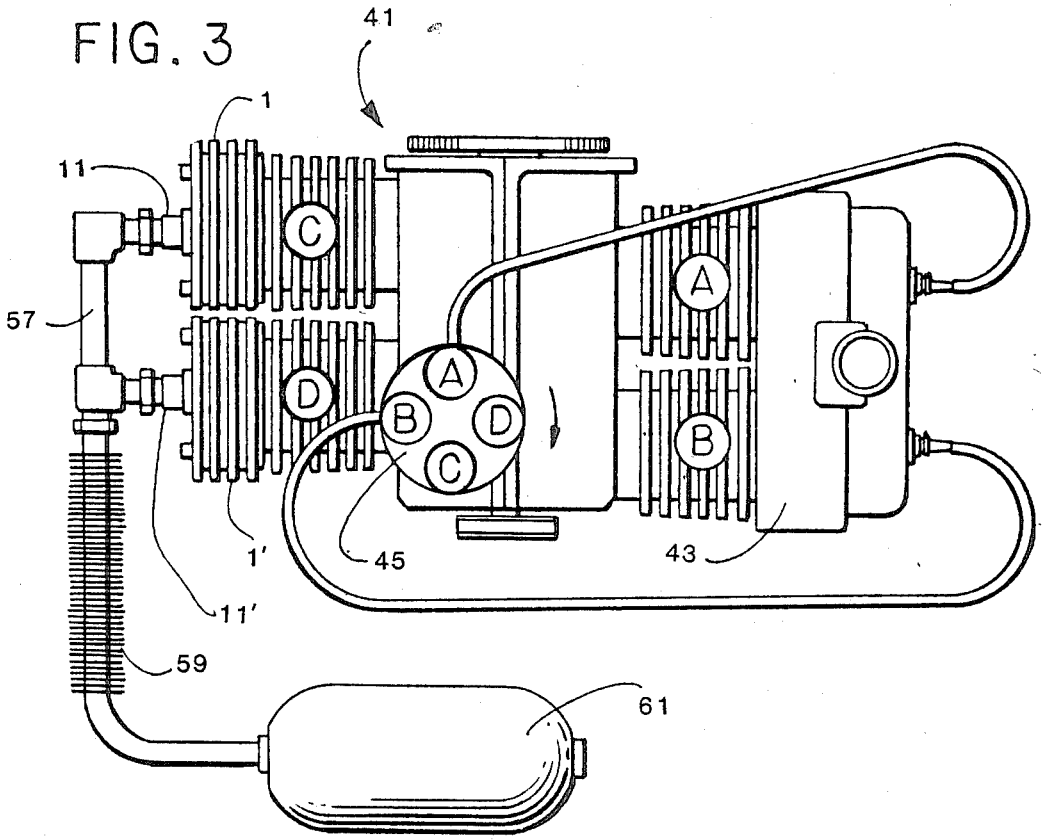
FIG. 3 of the drawings illustrates a modification of a Volkswagen engine in accordance with this invention.

FIG. 3 of the drawings is a top view of a Volkswagen engine 41 having a conventional head 43 and illustrating cylinder heads 1 and 1′ in accordance with this invention the left side thereof. It is seen that cylinders A and B of the right bank are actually operational, while cylinder C and D are air compressors. The firing sequence is illustrated schematically by distributor 45 wherein the firing sequence is A, D, C, B resulting in an actual firing sequence of B, A, [D], [C], B, A, [D], [C]. This highly unsymmetrical firing sequence was anticipated not to be operational, but upon installation of the cylinder heads of this invention was surprisingly found to be operational and efficient.

Figure 4:
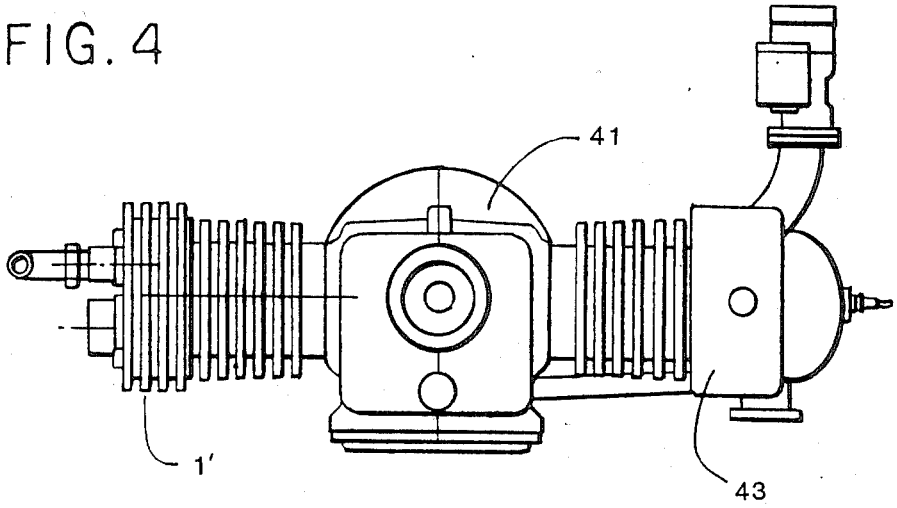
FIG. 4 of the drawings is a front view of the FIG. 3 view.

FIG. 4 of the drawings is a front view of the engine 41 showing in FIG. 3.

Figure 5:
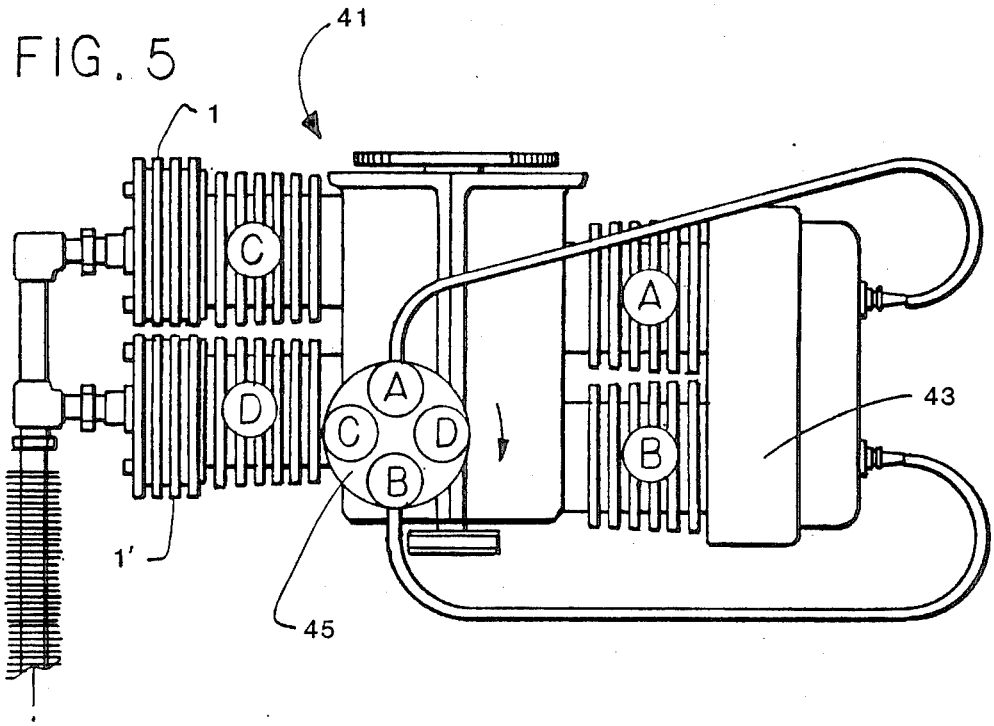
FIGS. 5 and 6 of the drawings illustrate yet other modifications of a Volkswagen engine in accordance with this invention.

FIG. 5 of the drawings illustrates a revised firing format where in actuality the firing sequence is A, [D], B, [C], A, [D], B, [C] to provide for more symmetry. This configuration requires modification to the existing crankshaft and camshaft to achieve the firing sequence.

Figure 6:
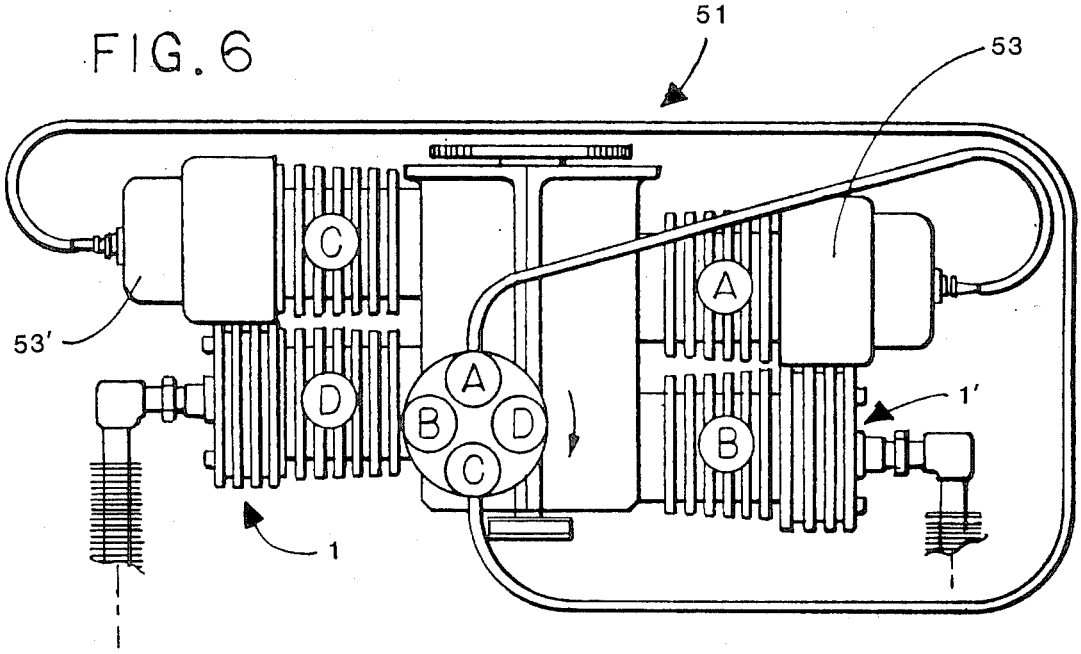

A further and more efficient configuration is illustrated in FIG. 6 of the drawings. As illustrated in FIG. 6, an engine 51 having cylinder heads 1 and 1' thereon on opposite sides of the engine is operated through modified running heads 53 and 53' to achieve a firing sequence of A, [D], C, [B] wherein the firing occurs at opposite sides of the engine. While this configuration is most efficient, it requires the most extensive engine modification requiring modified running heads, exhaust system and manifold adaptions.

Referring again to FIG. 3 of the drawaings, there is therein illustrated conduit means 57 in communication with outlet ports and 11 and 11'. There is additionally illustrated cooling means 59 in association with such conduit means to cool the compressed air. In some events it may be desirable to include a plenum 61 of compressed air. However, it has been found that utilizing the apparatus of this invention, compressed air may be utilized directly out of the compression cylinders.

Figure 7:
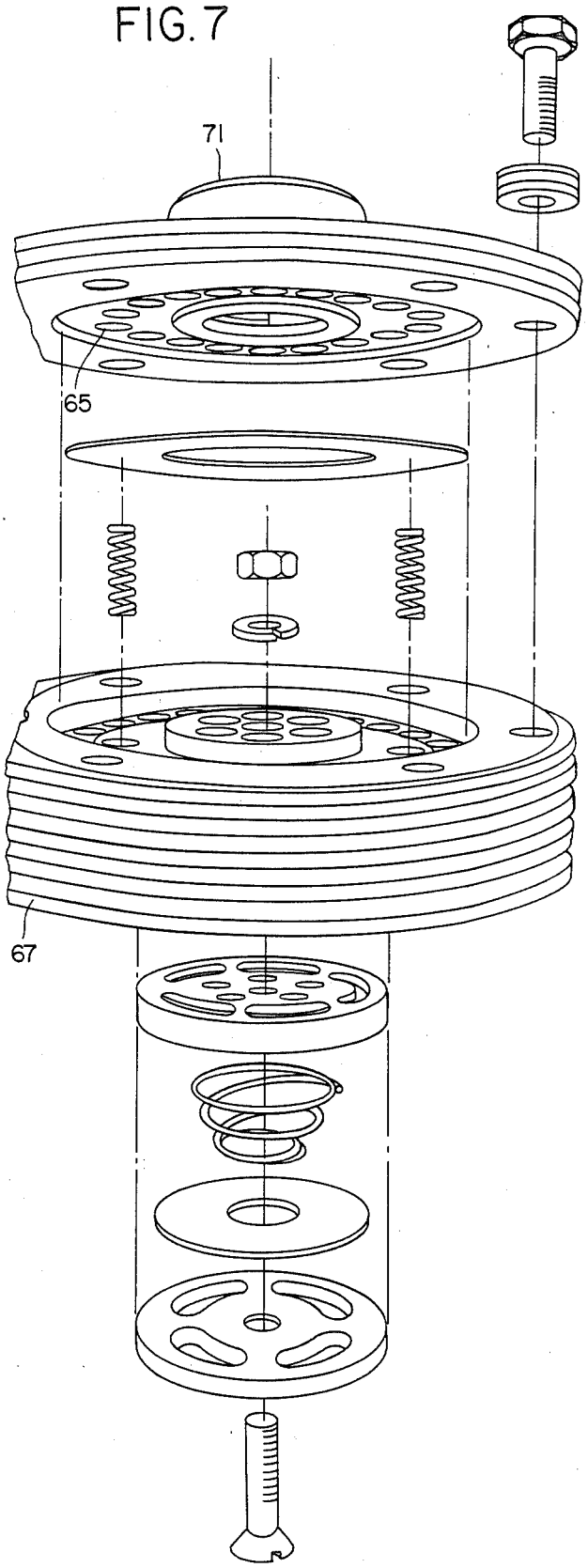
FIG. 7 is a schematic view of another embodiment of a cylinder head utilized in conjunction with this invention.

FIG. 7 of the drawings illustrates another embodiment of this invention wherein the inlet port 71 is centrally located within the cylinder head. In this instance the outlet port 65 is concentrally located about the inlet port. This has the advantage of providing cooling from a central area of the cylinder head, as well as from the fins 67 on the exterior thereof. This is a more cumbersome configuration, but has the advantage of increased cooling efficiency.

The invention herein disclosed may be coupled with other devices to improve the efficiency thereof. For example, the inlet valves may be coupled with unloaders to hold the valves open during periods of idle to save energy consumption during non-use. The invention also includes double ganging engines with various configurations of firing patterns.

It is thus seen that the apparatus of this engine provides a simple and efficient means for converting a Volkswagen engine to a compressor for air and provides for differing configurations to achieve that result. The apparatus of this invention provides a highly simplified air compressor which is capable of easy repair due to the availability of Volkswagen parts and service technicians and which is light and capable of easy handling and manipulation. As the above description is highly exemplified, the spirit and scope of this invention is to be measured by the following appended claims.

What is claimed is:

1. An internal combustion engine modified to produce compressed air, comprising:

an opposing four cylinder air cooled engine;

two of said cylinders of said opposing four cylinder air cooled engine being substantially unmodified so as to be responsive to internal combustion;

the remaining two cylinders of said opposing four cylinder air cooled engine being mechanically interlinked to said two unmodified cylinders and each defining a piston housing, a cylinder head adapted to mate with each piston housing, said cylinder head comprising a machined block of metal defining cooling fins on the exterior thereof, an inlet port and an outlet port communicating with the cylinder of said piston housing, a spring actuated outlet valve in said outlet port, a spring actuated inlet valve in said inlet port, means for retaining said inlet valve within said inlet port, and means for retaining said outlet valve within said outlet port, whereby upon operation of said engine said piston reciprocates within said cylinder to draw air through said inlet valve, compress said air within said cylinder and release compressed air through said outlet valve.

2. The apparatus according to claim 1 further including a plenum reservoir in communication with said outlet valve.

3. The apparatus according to claim 1 further including conduit means in communication with said outlet valve and including cooling means on said conduit means.

4. The apparatus according to claim 1 wherein said two (2) cylinders having said cylinder heads are on the same side of said engine.

* * * * *